US006816043B2

(12) United States Patent
Löwenborg et al.

(10) Patent No.: US 6,816,043 B2
(45) Date of Patent: Nov. 9, 2004

(54) WAVE-GUIDE AND A CONNECTOR THEREFOR

(75) Inventors: Claes-Göran Löwenborg, Vaxholm (SE); Joakim Ostin, Stockholm (SE)

(73) Assignee: Allgon AB, Taby (SE)

( * ) Notice: Subject to any disclaimer, the term of this patent is extended or adjusted under 35 U.S.C. 154(b) by 0 days.

(21) Appl. No.: 10/433,476

(22) PCT Filed: Dec. 10, 2001

(86) PCT No.: PCT/SE01/02728

§ 371 (c)(1),
(2), (4) Date: Jun. 11, 2003

(87) PCT Pub. No.: WO02/49140

PCT Pub. Date: Jun. 20, 2002

(65) Prior Publication Data

US 2004/0070467 A1 Apr. 15, 2004

(30) Foreign Application Priority Data

Dec. 11, 2000 (SE) ..... 0004569

(51) Int. Cl.[7] ..... H01P 1/04; H01P 1/18

(52) U.S. Cl. ..... 333/254; 333/157; 333/24 R

(58) Field of Search ..... 333/26, 33, 125, 333/156, 157, 21 R, 21 A, 24 R, 248, 239, 254

(56) References Cited

U.S. PATENT DOCUMENTS 4,728,910 A * 3/1988 Owens ..... 333/24 R
5,126,696 A * 6/1992 Grote et al. ..... 331/96
6,018,276 A * 1/2000 Hirota et al. ..... 333/26
6,232,849 B1 * 5/2001 Flynn et al. ..... 333/26
6,404,298 B1 * 6/2002 Rohr et al. ..... 333/21 A
6,549,106 B2 * 4/2003 Martin ..... 333/248
6,583,693 B2 * 6/2003 Paynter et al. ..... 333/254
6,710,674 B2 * 3/2004 Pitschi ..... 333/21 R
6,710,685 B1 * 3/2004 Sciarrino ..... 333/254

OTHER PUBLICATIONS

Patent Abstracts of Japan, vol. 12, abstract of JP 62–261201 A (NEC Corp), Nov. 13, 1987.

Derwent's Abstract No. 84–68357/11, Week 8411, Abstract of SU 1019–530 (Gedraitis K–P B), May 23, 1983.

* cited by examiner

*Primary Examiner*—Michael Tokar
*Assistant Examiner*—Linh V Nguyen
(74) *Attorney, Agent, or Firm*—Jacobson Holman PLLC

(57) ABSTRACT

A wave-guide having at least two connection points. In order to adapt a physical distance between these points to a variable distance between connection points of external equipment, at least one connector (20) is provided having a first connecting member (31) for connection to a connection point (28) of the wave-guide and a second connecting member (33) for connection to a connection point of the external equipment. The connecting members of the connector are laterally displaced such that rotation of the second connecting member (33) about the first one (31) results in a variation of the distance between the second connecting member and another connection point of the wave-guide.

8 Claims, 4 Drawing Sheets

WAVE-GUIDE AND A CONNECTOR THEREFOR

This is a nationalization of PCT/SE01/02728 filed Dec. 10, 2001 and published in English.

FIELD OF THE INVENTION

The present invention concerns a wave-guide and a connector therefor as stated in the pre-ambles of claims 1 and 4, respectively.

BACKGROUND OF THE INVENTION

When connecting different radio equipment to each other, it is sometimes crucial that a defined electrical length between two connection points is maintained. Due to mechanical tolerances, however, the physical distance between such points may vary. It is convenient then to use coaxial cables, since these are flexible and allow easy adjustment of the mutual distance between connectors applied at opposed ends of a cable. However, coaxial cables are afflicted with rather high internal losses. An alternative to a coaxial cable is a wave-guide. A wave-guide has low internal losses, but is a non-flexible system having a fixed distance between its connectors.

It would be desirable, thus, to combine the low internal losses of a wave-guide with the flexibility of a coaxial cable as regards the distance between connectors at its ends.

SUMMARY OF THE INVENTION

Based on the desirous properties of a wave-guide, the problem to be solved by the present invention is to provide a wave-guide having a fixed electrical length and a variable physical length, i.e., a variable distance between connection points thereof so as to adapt said distance to a distance between connectors of equipment to which the wave-guide is to be connected. It is also a problem to provide a connector for a wave-guide having a fixed electrical length, said connector allowing, or, compensating for, a varying distance between connection points of equipment to be connected to the wave-guide.

In solving the first problem mentioned, the present invention provides a wave-guide arranged such that at least one of its connection points is moveable in relation to another of its connection points. This is accomplished by providing a wave-guide equipped with at least one connector having first and second connecting members mutually connected for signal transmission therebetween and having a first and a second axis, respectively. The first connecting member is connected to the wave-guide member to be rotatable about the first axis. The second axis is offset in relation to the first axis such that the second connecting member with the second axis is rotatable about the first axis, so that the second connection member may describe a circular movement, thereby varying the physical distance by relative movement of said connectors without affecting the electrical length of the wave-guide.

In solving the second problem mentioned, the present invention provides a connector having a first connecting member at one end for connection to a connection point of a wave-guide, and a second connecting member at an opposed end for connection to external equipment. The first and second connection members are laterally displaced relative to one another such that rotation of the connector about the first connecting member results in a circular movement of the second connecting member and, thereby, a varying distance of said second connection member in relation to another connection point of the wave-guide without affecting the electrical length therebetween.

BRIEF DESCRIPTION OF THE DRAWINGS

Two embodiments of the present invention will be described hereinafter, reference being made to the accompanying drawings referring to an example where signals from two signal processing apparatuses are combined into one signal transferred to subsequent apparatus.

DETAILED DESCRIPTION OF PREFERRED EMBODIMENTS

Figure 1:
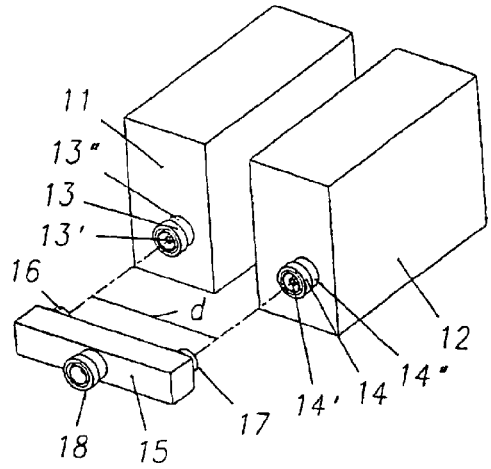
FIG. 1 is a schematic perspective view showing two signal processors and a wave-guide for attachment thereto.

In FIG. 1 are shown the cabinet 11 of a first signal processing device and the cabinet 12 of a second signal processing device having signal output terminals 13, 14, respectively, of the kind including a central core 13', 14', respectively, defining the axis of a cylindrical jacket 13", 14", respectively, surrounding the core. The cabinets 11 and 12 are positioned side-by-side in a substantially abutting relationship, for instance in a non-shown rack, such that there is a nominal, defined distance d between the cores 13', 14' adapted to a standard wave-guide 15 having two connectors 16, 17 for incoming signals and one connector 18 for an outgoing signal to be transferred to further, non-shown equipment of a signal chain. However, due to, e.g., manufacturing tolerances, the nominal distance d may vary a few millimeters—not much—but sufficiently for a standard wave-guide not to fit to the two output terminals 13, 14.

Figure 2:
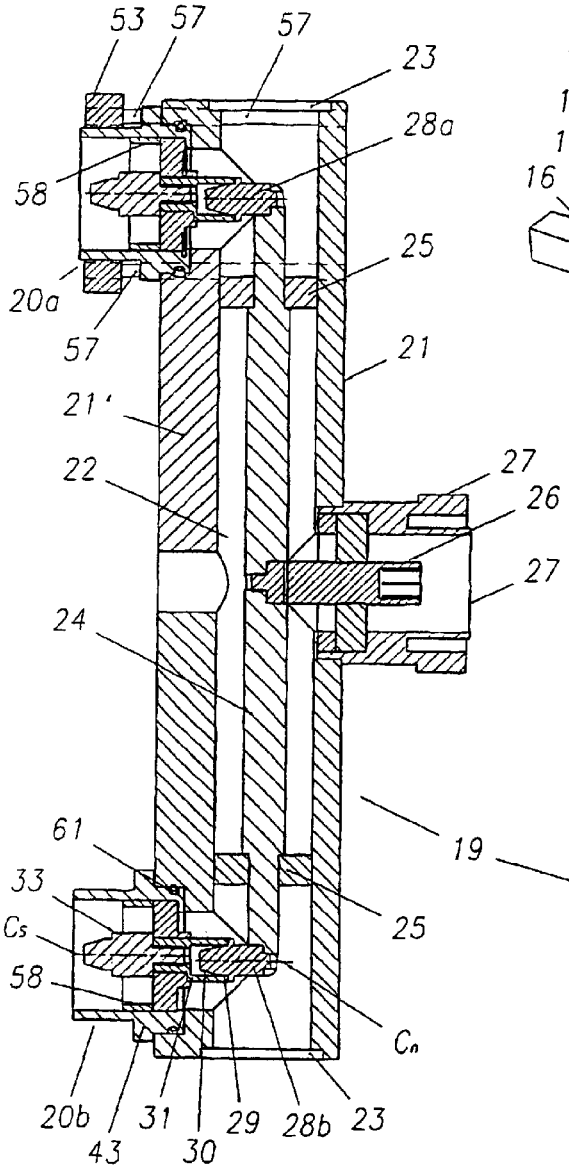
FIG. 2 is a section taken along line II-II in FIG. 3 through a wave-guide having two connectors according to a first embodiment of the present invention.
Figure 3:
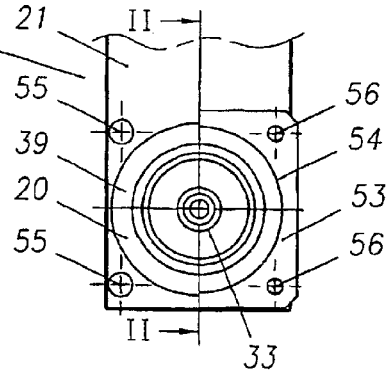
FIG. 3 is a front view of a portion of the wave-guide of FIG. 2.
Figure 4:
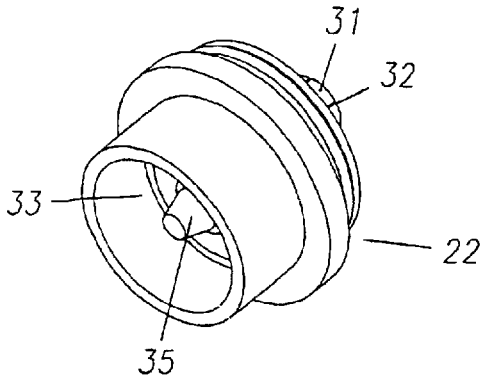
FIG. 4 is a perspective view of a connector according to is the first embodiment.
Figure 5:
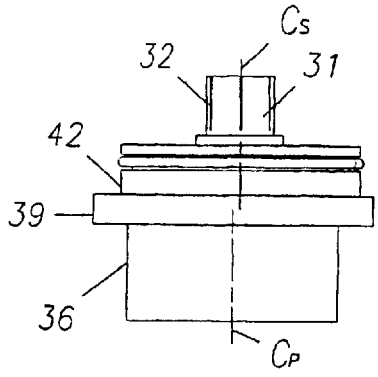
FIG. 5 is a first side view of the connector of FIG. 4.

The present invention overcomes this drawback by providing the wave-guide 19 shown in FIG. 2 and partly in FIG. 3 and having connectors 20 (a and b) shown more in detail in FIGS. 4–9.

Figure 10:
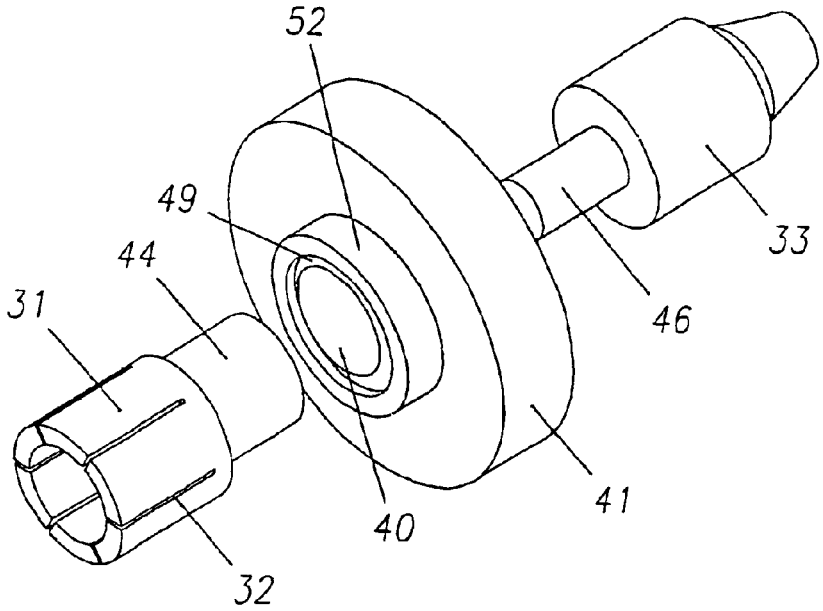
FIGS. 10 and 11 are exploded views at an enlarged scale showing a contact sleeve, a dielectric disc and a contact pin from different directions.
Figure 11:
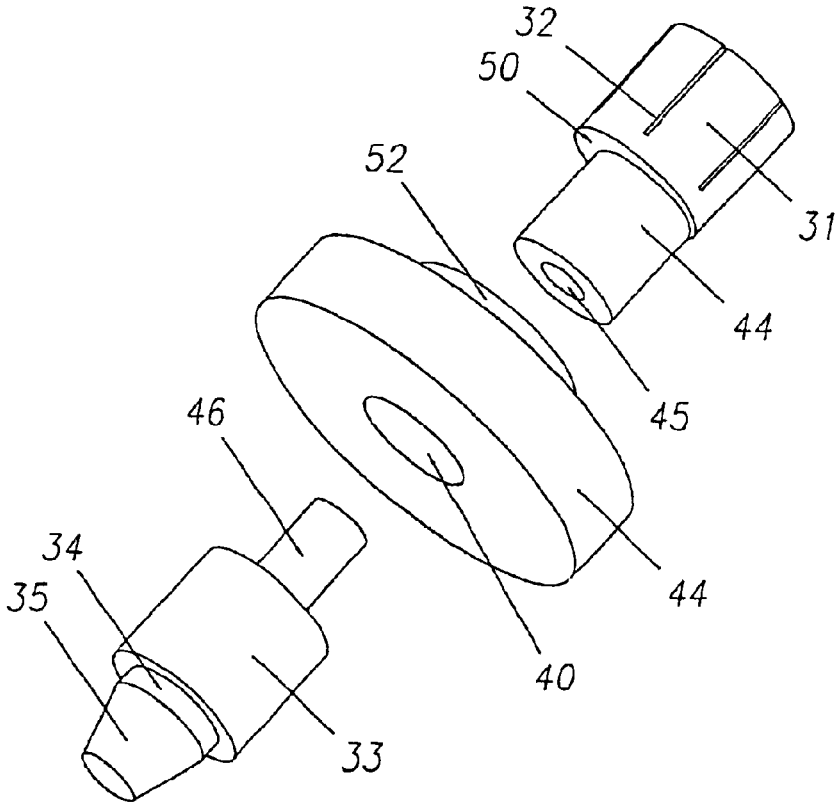

The wave-guide 19 includes a longish metal housing 21 having an internal cavity 22 extending in the longitudinal direction of the housing. The cavity is closed at opposed ends of the housing by covers 23. A metal bar 24 extends interiorly of the housing and is kept centred in the cavity by means of dielectric washers 25. A central contact sleeve 26 of a connector 27 is connected to the mid-point of the bar 24. Connecting pins 28 (a—upper; b—lower in FIG. 2) having respective centre lines or axes $C_n$ (nominal centre; defining the nominal distance d between connectors of a state-of-art wave-guide) are secured, e.g. by screwing or soldering, to opposed ends of the metal bar 24 to extend substantially perpendicularly thereto. An outer, free end of each connecting pin has a cylindrical contact portion 29 and terminates in a conical end portion 30 serving as a guide portion to guide a cylindrical contact sleeve 31 of a connector 20 when brought into engagement with the cylindrical portion 29 of the connecting pin (see lower connector 20*b* in FIG. 2). The contact sleeve has a centre line or axis $C_s$ that is aligned with the centre line $C_n$ of the connecting pin 28 when the contact sleeve is fitted on the connecting pin. The contact sleeve is preferably slotted at 32 (see particularly FIGS. 10 and 11) to be slightly expandable when mounted onto a connecting pin 28.

The contact sleeve 31 contacts a contact pin 33 of a connector 20. The contact pin has a centre line or axis $C_p$ (FIG. 9), a cylindrical contact portion 34 and a conical end portion 35. An annular collar 36 having a central bore 37 coaxially encircles contact pin 33. At an inner end of the bore 37 there is provided an inwardly directed flange 38. Exteriorly, the collar 36 has an annular flange portion 39. A circular disc 41 is unrotationally received within the bore 37 abutting and supported by the flange 38. The disc 40, being made of a dielectric material, preferably Teflon®, has a central bore 40 having an axis concentric to the axis $C_p$. The contact sleeve 31 and the contact pin 33 are received in the bore 40.

An extension 42 of the annular collar 36 beyond the flange 39 has a cylindrical shape conforming to a cylindrical bore 43 in the housing 21 co-axial to the connecting pin 28. When connected to the wave-guide, the cylindrical extension 42 is introduced into the bore 43, the flange 39 resting against an external wall of the wave-guide housing 21 as shown in FIG. 2.

Figure 6:
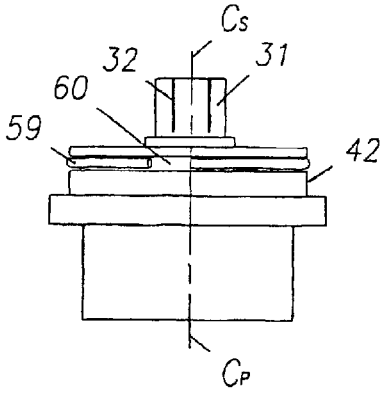
FIG. 6 is a second side view of the connector of FIG. 4.

In a state-of-art connector, the contact sleeve and the contact pin are generally integral and have a common axis, i.e., any side view thereof would have an appearance resembling the particular side view of FIG. 6. This means that the distance between two connecting pins 28 of state-of-the-art connectors is equal to the nominal distance d between two contact pins 33, since all three axes concerned ($C_n$, $C_s$ and $C_p$) are aligned.

However, and as stated above, when connecting two juxtaposed apparatuses, the distance between their terminals 13, 14 (FIG. 1) may differ from the required nominal distance d fixed by the inherently non-flexible wave-guide.

To overcome this problem, the present invention provides for lateral displacement of the axis $C_p$ of at least one contact pin 33 in relation to the axis $C_n$ of the associated connecting pin 28.

This is accomplished by laterally displacing the contact sleeve 31 including its axis $C_s$ in relation to the contact pin 33 including its axis $C_p$, and by making the contact pin 33 rotatable about the axis $C_s$. Thus, rotation of the contact pin 33 about the axis $C_s$ causes a maximum lateral movement of the contact pin 33 equal to twice the relative eccentricity e, typically 0.75 mm, of the two axis $C_s$ and $C_p$, i.e., a maximum movement of typically 1.5 mm.

In practice, in a connector 20 according to the present invention, the contact sleeve 31 is formed with two cylindrical portions, one portion constituting an attachment shank 44 insertable in the bore 40 in the disc 41 and having an axis co-axial with the axis $C_p$, and one portion constituting the contact sleeve 31 itself having its axis $C_s$ offset from the axis $C_p$. The shank 44 has an internal bore 45 threaded for engagement with corresponding external threads on an attachment shank 46 of contact pin 33 (the threads are not shown in the drawings). Evidently, other manners of connecting the contact sleeve and the contact pin will be apparent to the skilled person, including soldering and press fitting.

As an alternative to making the contact sleeve and the contact pin as two connectable parts, they could be made in one piece, and the disc 41 could be pressed onto the common shank thereof.

It is important to make sure that the contact sleeve 31 is non-rotatable relative to the extension 42 of the annular collar 38. As stated above, the disc 41 is unrotatably received within the bore 37. To make the contact sleeve unrotatable relative to the disc, several possibilities exist, one of which will be described hereafter.

The contact sleeve 31 is let into a cylindrical recess 49 in the disc 41 such that a bottom surface 50 of the contact sleeve rests on a crescent-like surface 51 of the disc extending around a major portion of the bore 40. It is preferred to make the recess 49 in a hub portion 52 of the disc concentric to the contact sleeve 31. Since a lower portion of the exterior peripheral wall of the contact sleeve abuts the side wall of the recess in the position shown particularly in FIG. 9, and due to the eccentricity of the contact sleeve, the latter and the contact pin 33 are kept unrotatable relative to the disc 41. Since the disc is unrotationally held in the bore 37, rotation of the connector 20 will bring along the disc 41, the contact sleeve 31 and the contact pin 33 in such rotation.

However, in order to enable rotation of the connector 20 in its operative position as mounted in the wave-guide, also the cylindrical extension 42 must have an eccentricity corresponding to that of the contact sleeve 31 in relation to its shank. Thus, the cylindrical extension 42 has an axis common with the axis $C_s$ of the contact sleeve 31 as appears best from FIG. 5. Consequently, when rotating the connector 20 having its extension 42 received within the associated bore 43 in the wave-guide housing 21, the contact pin 33 will perform a circulating movement about the common axis $C_s$ of the bore 43 (FIG. 2), the contact pin 28 and the contact sleeve 31. During this movement, the contact pin 33 will occupy positions located at various distances from another contact pin 33 of the same wave-guide. Evidently, the movement of the contact pin is not linear in the longitudinal direction of the wave-guide housing since it is a circular movement. However, the slight raising and lowering of a contact pin relative to its two truly lateral end positions does not affect the adaption of the distance between two contact points in an adverse manner.

Figure 7:
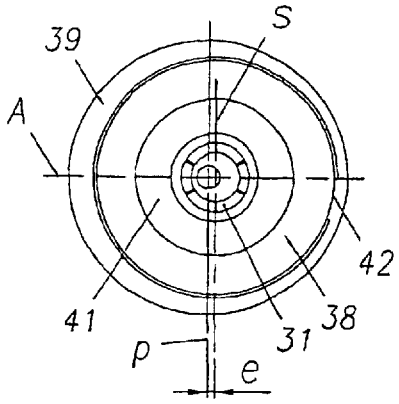
FIG. 7 is a top view of the connector of FIG. 4.
Figure 8:
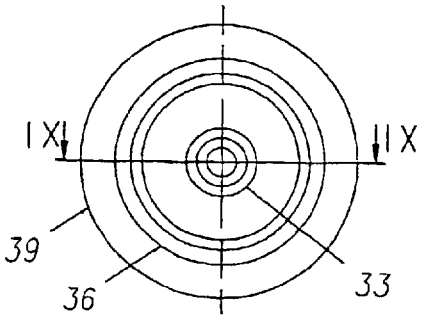
FIG. 8 is a bottom view of the connector of FIG. 4.
Figure 9:
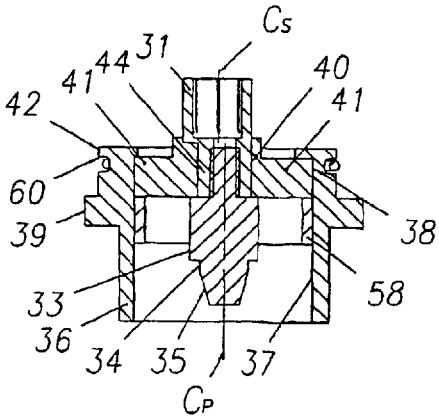
FIG. 9 is a cross section through the connector of FIG. 4 taken along line IX-IX of FIG. 8.

The eccentricity e is particularly shown in FIG. 7 as the distance between two lines p and s intersecting a line of symmetry A to define $C_p$ and $C_s$, respectively.

Once the rotational position of a connector 20 has been adjusted as indicated above to fit a certain distance deviating from the nominal distance d, its position is fixed by clamping it against the wall 21' of the wave-guide housing 21. For this purpose, a clamp flange 53 shown with the upper connector 20*a* in FIG. 2 is provided having a central bore 54 dimensioned to receive the collar 36 with clearance enough to allow rotation of the connector in a non-clamped position of the clamp flange. The clamp flange could be annular, but it is preferred to make it substantially square as seen in FIG. 3 showing half the clamp flange. For its attachment and clamping, the wave-guide housing 23 is provided with four through-holes 55, and the clamp flange is provided with corresponding holes 56. The holes 56 are threaded to receive clamping screws 57 extending through the housing 23. In order to accommodate movement of the clamp flange due to rotation of the connector 20, the holes 55 in the wave-guide housing have a substantially larger diameter than the screws. For a typical screw diameter of 3 mm the holes 55 have a diameter of typically 4.5 mm.

The clamp flange 53 may be internally threaded (not shown) for engagement with corresponding threads of a terminal 13, 14 (FIG. 1) for the purpose of firmly connecting the wave-guide to a signal processing device and to obtain optimum signal transmitting properties. In this case, the clamp flange 53 need not press against the flange 39 of the connector, since a corresponding press force is obtained at the outward end of the collar 36.

As an alternative, the clamp flange 53 may be excluded, and the screws 57 may be screwed into a cabinet 11, 12 (FIG. 1).

To keep the dielectric disc 41 firmly against the flange 38 a retaining ring 58 (FIG. 9) is pressed into the bore 37 to abut the disc 41. Further, a spring 59 (FIG. 6) in the shape of a slotted ring may be arranged in an annular recess 60 formed in the circumference of the extension 42 of the casing 36 to partly snap into a corresponding annular recess 61 formed in the bore 43 (FIG. 2).

A second embodiment of a connector 62 is described with reference to FIGS. 12, 13 and 14. It should be noted, however, that there is no difference as regards the inventive idea to make the two connection portions of a connector offset; the differences reside mainly in details concerning its attachment to the wave-guide housing and its interior structure.

Figure 12:
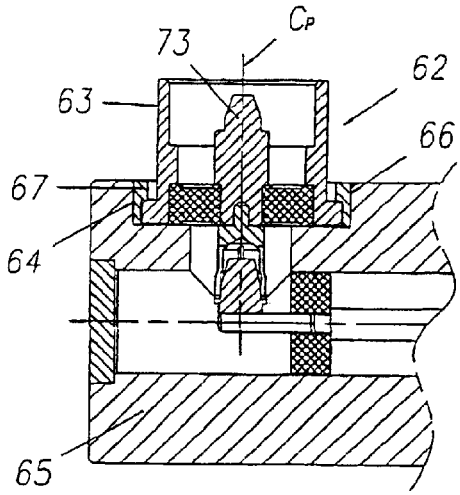
FIG. 12 is a section through an end of a wave-guide and a second embodiment of a connector according to the present invention.
Figure 13:
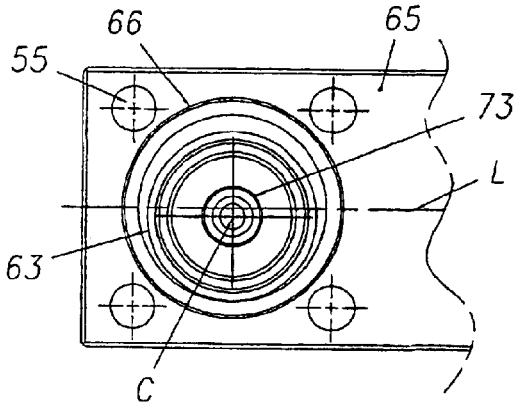
FIG. 13 is a front view of the wave-guide and connector of FIG. 12.
Figure 14:
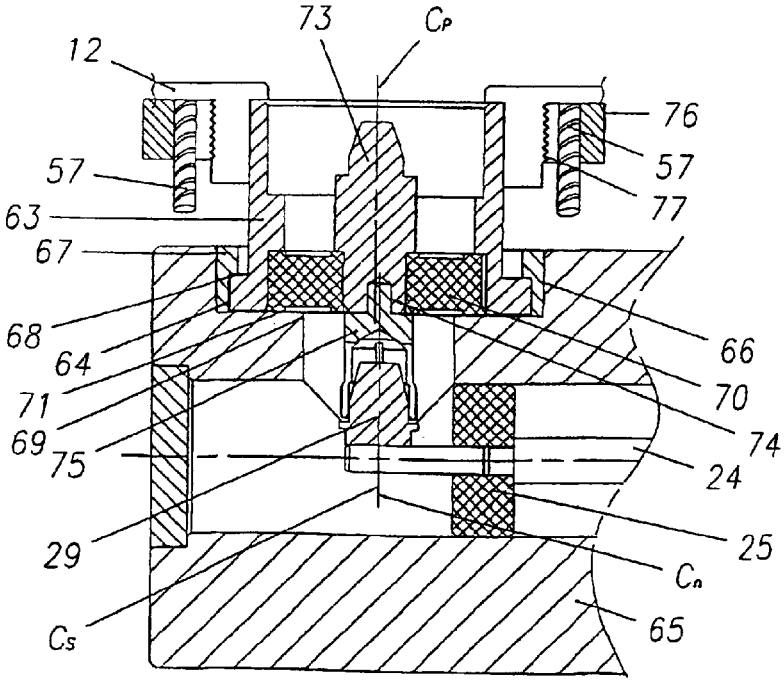
FIG. 14 is a section corresponding to FIG. 12, but showing the connector at an enlarged scale and in another rotational position.

As seen in FIG. 12 and best in the enlarged view of FIG. 14, the connector casing 63 has a radially outwardly extending flange 64 at its inner end, and the wave-guide housing 65 has a bore 66 with a larger diameter than the flange 64. A ring 67 having a shoulder 68 abutting the flange 64 is pressed into the bore 66 so as to rotatably hold the connector in the bore contacting the bottom surface 69 of the bore. A dielectric disc 70 is held between an inwardly directed flange 71 of the casing 63 and the surface 69.

Contrary to the previous embodiment, the shank 72 of a contact pin 73 extends through the disc 70, and the shark 74 of a contact sleeve 75 is threaded into the shank of the contact pin. The contact pin and the contact sleeve are shown in FIG. 12 in a rotational position where the eccentricity of their axes is not visible. In FIG. 13, however, it is clearly visible that the contact pin 73 as well as the connector casing 63 have their common centre C offset in relation to the centre line L of the wave-guide housing and its bore 66. Also in FIG. 14 the eccentricity between the axes $C_p$ and $C_s$ ($=C_p$) is visible as is the resulting difference in width of the flange 64.

As in the first embodiment, a separate flange 76 similar to flange 53 is used to prevent rotation of the connector once it is set in a proper position. The flange 76 is partly shown in FIG. 14 and is internally threaded to be threadedly engagable with threads 77 of, e.g., a terminal 14 of signal processing equipment 12. Screws 57 extending through the wave-guide housing 65 and screwed into the flange 76 pull the wave-guide housing and the connector together at the same time as they pull the connector towards the terminal 14. Evidently, increased friction between the connector and the wave-guide housing will effectively prevent rotation of the connector relative to the wave-guide housing.

As would be apparent from the foregoing description, the fixed electrical length referred to as regards the particular wave-guide 19 shown in FIG. 2 is the sum of the electrical lengths of the metal bar 24 and of two connecting pins 28 at its ends as well as of the two contact sleeves 31 and two contact pins 33 of the two connectors 22*a* and 22*b*, whereas the variable physical distance is the prevailing distance between the axes $C_p$ of the contact pins 33.

Although the above given description of preferred embodiments of the invention refers to a T- or Y-shape wave-guide having two connectors 20*a*, 20*b* (or 62) for incoming or outgoing signals and one connector 27 for outgoing or incoming signals, respectively, it would be evident that the invention is as well practicable on a wave-guide having but two connectors, e.g., one connector 20*a* and one connector 27 (Z-shape), or, two connectors 20*a*, 20*b* (c-shape).

What is claimed is:

1. A wave-guide having a fixed electrical length between connection points thereof and for adapting a physical distance (d) between said connection points to a varying distance between connection means (13, 14) of equipment (11, 12) to be connected to said wave-guide while maintaining said fixed electrical length, said fixed electrical length being constituted by at least a portion of a wave-guide member (24) received in a wave-guide housing (21) and two connectors (20) connected to said wave-guide member at discrete points therealong, at least one of said connectors (20*b*) including first (31) and second (33) connecting members mutually connected for signal transmission therebetween and having a first and a second axis, respectively, said first connecting member (31) being connected to said wave-guide member to be rotatable about said first axis, characterized in that said second axis ($C_p$) is offset in relation to said first axis ($C_s$).

2. The wave-guide according to claim 1, said first connecting member (31, 44) being at least partially co-axially encircled by a first annular portion (42) of a connector casing fitting into a bore (43) in said wave-guide housing and being rotatable therein, characterized in that said second connecting member (33) is co-axially encircled by a second annular portion (36) of said casing and rotatable about said first axis ($C_n$).

3. The wave-guide according to claim 2, characterized by a clamping flange (53) having a hole (54) therein receiving said second annular portion (37), said clamping flange bearing against a flange portion (39) of said casing, said clamping flange being clampable to said housing by means of clamping means (57) extending through bores (55) in said wave-guide housing (21), said bores having a cross section enabling limited lateral movement of said clamping means.

4. A connector for a wave-guide having a fixed electrical length between connection points (16, 17) thereof and for adapting a physical distance (d) between said points to a varying distance between connection means (13, 14) of equipment (11, 12) to be connected to said wave-guide while maintaining said electrical length, said connector (20) having a first end having a first connecting member (31) for connection to one of said connection points (28*a*) of said wave-guide and a second end having a second connector portion (33) for connection to a said connection means (13, 14), said first and second connecting members (31, 33) having a first ($C_s$) and a second ($C_p$) axis, respectively, characterized in that said first ($C_s$) and second ($C_p$) axes are laterally displaced relative to one another.

5. The connector according to claim 4, characterized in that said first connecting member includes a cylindrical engagement portion (31) having said first axis ($C_s$) and being shaped for engagement with said one connection point (28), and a shank portion (44) offset from said engagement portion and having said second axis ($C_p$) common with said second connecting member (33) connected thereto.

6. The connector according to claim 5, characterized in that said second connecting member (33) includes a shank portion (46) joined to said shank portion (44) of said first connector portion (31), said joined shank portions extending through a circular disc (41) of a dielectric material co-axial to said second axis ($C_p$) and received within a cylindrical bore (37) of a casing of said connector co-axial to said second connecting member (33).

7. The connector according to claim 6, characterized in that said first and second connecting members are integral.

8. The connector according to claim 6, characterized in that said casing includes a cylindrical attachment portion (42) having an axis common with said first axis ($C_s$) and being dimensioned to be rotationally receivable in a cylindrical bore (43) in a wall of a housing (21) of said waveguide.

* * * * *